US007825353B2

(12) United States Patent
Shingler

(10) Patent No.: US 7,825,353 B2
(45) Date of Patent: Nov. 2, 2010

(54) ELECTRIC COOKING APPARATUS

(75) Inventor: Robert A. Shingler, Beaverton, OR (US)

(73) Assignee: Evo, Inc., Beaverton, OR (US)

( * ) Notice: Subject to any disclaimer, the term of this patent is extended or adjusted under 35 U.S.C. 154(b) by 202 days.

(21) Appl. No.: 11/544,478

(22) Filed: Oct. 5, 2006

(65) Prior Publication Data

US 2007/0084853 A1 Apr. 19, 2007

Related U.S. Application Data

(60) Provisional application No. 60/724,247, filed on Oct. 5, 2005.

(51) Int. Cl.
*H05B 3/68* (2006.01)
*F24C 3/00* (2006.01)

(52) U.S. Cl. ..... 219/452.11; 219/450.1; 219/451.1; 219/452.12; 219/460.1; 219/461.1; 219/462.1; 126/39 K; 126/90 A; 126/211; 126/21 R; 126/21 A

(58) Field of Classification Search ..... 219/450.1, 219/451.1, 452.11, 452.12, 460.1, 462.1, 219/461.1; 126/393, 39 K, 90 A, 211, 21 R, 126/21 A See application file for complete search history.

(56) References Cited

U.S. PATENT DOCUMENTS 3,317,709 A 5/1967 Beasley
3,606,612 A 9/1971 Raid, Jr.
3,824,984 A 7/1974 Swanson et al.
3,843,313 A 10/1974 Helgeson
4,062,341 A 12/1977 Panzarella
4,108,142 A 8/1978 Barson et al.
4,313,416 A 2/1982 Lau
4,342,259 A 8/1982 Lee
4,353,347 A 10/1982 Seed
4,452,224 A 6/1984 Misumida
4,481,408 A 11/1984 Scheufler
4,553,524 A 11/1985 Wheat et al.
4,889,103 A 12/1989 Fraioli
4,957,039 A 9/1990 Reyes
5,072,718 A 12/1991 Seal
5,127,824 A 7/1992 Barker
5,158,067 A 10/1992 Dutro et al.
5,270,519 A 12/1993 Higgins
5,413,087 A 5/1995 Jean
5,676,043 A 10/1997 Best
6,150,636 A * 11/2000 Bogdanski et al. ..... 219/461.1
6,189,530 B1 * 2/2001 Shingler ..... 126/41 R
6,384,387 B1 * 5/2002 Owens et al. ..... 219/601
6,529,686 B2 * 3/2003 Ramanan et al. ..... 392/418
7,001,627 B2 * 2/2006 Marson ..... 426/233
7,173,219 B2 * 2/2007 Okajima et al. ..... 219/444.1

FOREIGN PATENT DOCUMENTS

EP 1 400 151 B1 10/2004

* cited by examiner

*Primary Examiner*—Shawntina Fuqua
(74) *Attorney, Agent, or Firm*—Alleman Hall McCoy Russell & Tuttle LLP

(57) ABSTRACT

Various embodiments of an electrical cooking apparatus are disclosed. In one embodiment, an electrical cooking apparatus includes a substantially continuous cooking surface, a plurality of electrical heating elements disposed under the substantially continuous cooking surface, and at least two temperature controllers configured to allow independent control of temperatures of at least two of the plurality of heating elements.

19 Claims, 5 Drawing Sheets

ELECTRIC COOKING APPARATUS

CROSS-REFERENCE TO RELATED APPLICATIONS

This application claims priority from U.S. Provisional Patent Application Ser. No. 60/724,247, filed Oct. 5, 2005 for an ELECTRIC COOKING APPARATUS, the disclosure of which is hereby incorporated by reference.

TECHNICAL FIELD

The present disclosure relates to an electric cooking apparatus, and more particularly to an electric cooking apparatus with independently controllable temperature zones.

BACKGROUND

Various cooking devices that utilize electric heating elements are known. However, such cooking apparatuses generally utilize heating elements configured to heat a cooking surface to a generally uniform temperature. For example, many electrical stovetops include a plurality of individual heating elements separated by unheated spaces. The temperature of each element is generally not controllably variable across a surface area of the element, but rather is configured to be uniform across the element.

SUMMARY

Various embodiments of an electrical cooking apparatus are described. In one embodiment, an electrical cooking apparatus includes a substantially continuous cooking surface, a plurality of electrical heating elements disposed under the substantially continuous cooking surface, and at least two temperature controllers configured to allow independent control of temperatures of at least two of the plurality of heating elements.

BRIEF DESCRIPTION OF THE DRAWINGS

The disclosure is illustrated by way of example and not by way of limitation in the accompanying figures, in which the like references indicate similar elements and in which.

DETAILED DESCRIPTION OF THE DEPICTED EMBODIMENTS

Figure 1:
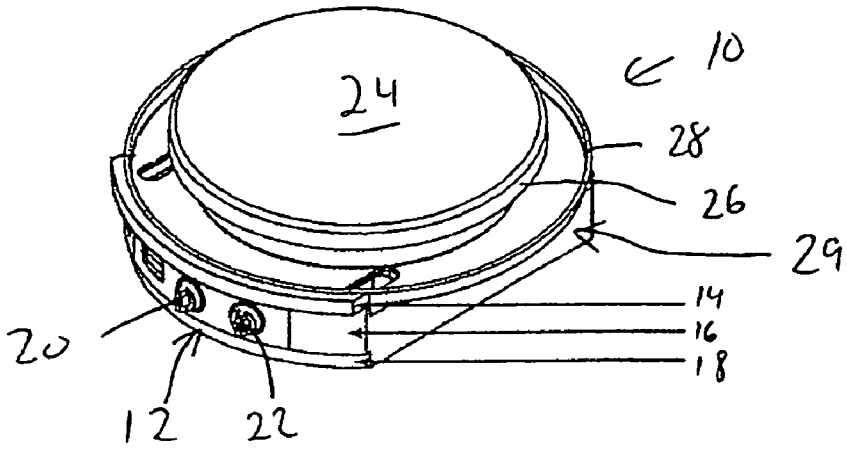
FIG. 1 shows a perspective view of an exemplary embodiment of a cooking apparatus according to the present disclosure.
Figure 2:
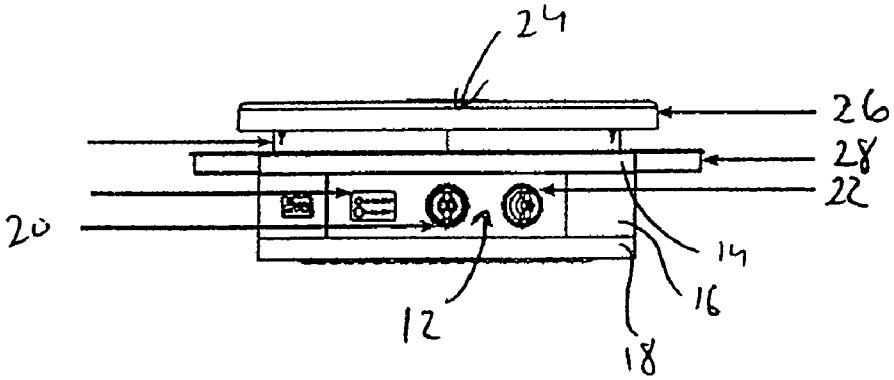
FIG. 2 shows a front view of the embodiment of FIG. 1.

The present disclosure relates to electric cooking apparatuses for both indoor and outdoor use. FIGS. 1 and 2 show a first exemplary embodiment of a cooking apparatus 10. Cooking apparatus 10 includes a control panel 12 having a three tier fascia with a crown top 14, a front face 16, and a lower trim 18. Two knobs 20, 22 are mounted to the control panel for controlling the cooking surface temperature—one for controlling the temperature of a first temperature zone, and another for controlling the temperature of a second temperature zone, as described in more detail below. The independently controllable temperature zones may allow different regions of the cooking surface to be controllably maintained at different temperatures.

Cooking apparatus 10 further includes a substantially continuous cooking surface 24 disposed over one or more heating elements, as described in more detail below. The term "substantially continuous" as used herein indicates that substantially the entire cooking surface is useable for the cooking of foods, as opposed to an electric stove top having heating elements spaced apart by non-cooking surfaces. While the depicted embodiment has a generally flat, circular cooking surface, it will be appreciated that the cooking surface may have any suitable shape, profile, surface texture, etc. Examples of suitable shapes include but are not limited to oval, rectangular, other curvilinear and/or polygonal shapes, and combinations thereof. Furthermore, while the depicted embodiment includes two control knobs 20, 22 for controlling two temperature zones, it will be appreciated that a cooking apparatus according to the present disclosure may have any suitable number of control knobs and associated temperature zones, including but not limited to three or more. Further, some embodiments may include only a single control knob for controlling one or more heating elements.

Cooking surface 24 may be formed from any suitable material. Suitable materials include, but are not limited to, ceramic coated stainless steel or mild steel, or uncoated stainless steel or mild steel that may be oil-seasoned or otherwise treated. Likewise, cooking surface 24 may have any suitable size. Suitable sizes include, but are not limited to, diameters between 20-35 inches. In one specific exemplary embodiment the cooking surface has a diameter of 25 inches, and in another specific exemplary embodiment the cooking surface has a diameter of 30 inches. In alternative embodiments, cooking surface 24 may have a diameter outside of this range. Cooking surface 24 may have a flat configuration, or may be convex (crowned) edge-to-edge. Where the cooking surface is crowned, the crown may have any suitable elevation measured from edge to center. Examples include, but are not limited to, elevation of 0.125-0.25 inches. Alternatively, the crown may have an elevation outside of this range.

An integral downward flange 26 may be provided around the edge of cooking surface 24 to capture radiant heat generated by the heating elements. Flange 26 also may be configured to direct excess cooking juices to a center portion of a drip pan 28 located below the rim of the cooking surface, thereby preventing such juices from missing drip pan 28. Alternatively, flange 26 may be omitted.

Cooking apparatus 10 further may include a base 29 configured to facilitate the mounting of the apparatus to one of the above support structures. In the depicted embodiment, base 29 is shown having a generally square or rectangular shape, except for a curved front panel portion that forms one side of the square or rectangle. However, it will be appreciated that the base may have any other suitable shape.

In some embodiments, drip pan 28 may be configured to overhang base 29. This may help to cover the area where cooking apparatus 10 is mounted to a supporting surface, and therefore may give cooking apparatus 10 a pleasing appearance and also may help to keep the mounting area clean from cooking residues.

Figure 3:
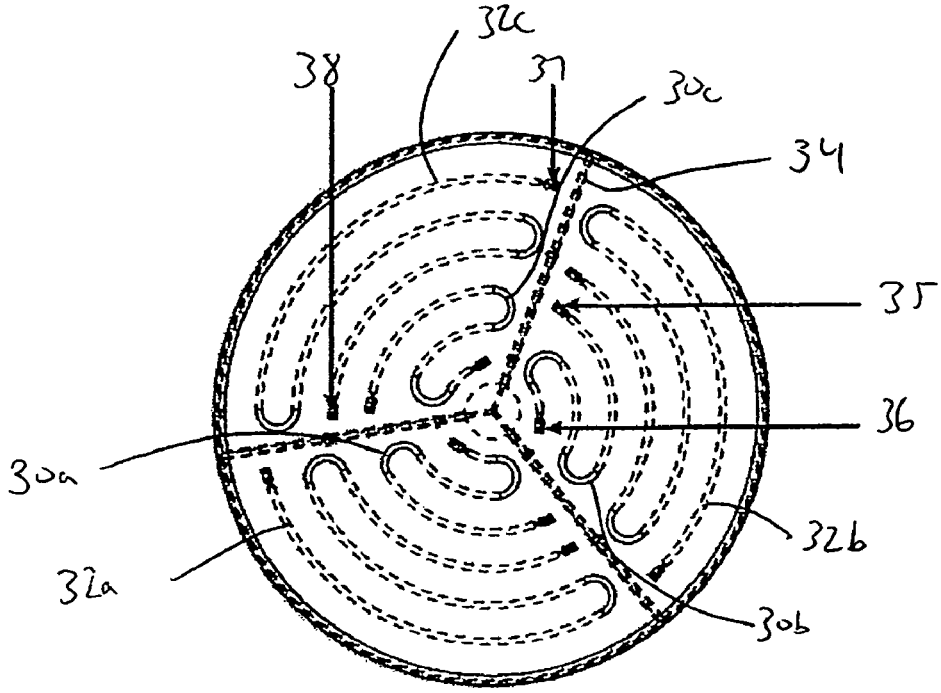
FIG. 3 shows a bottom view of the embodiment of FIG. 1, with the heating element assembly shown in dashed lines.

FIG. 3 depicts an exemplary inner and outer heating element configuration. An inner heating element assembly is shown by inner heating element segments 30*a*, 30*b* and 30*c*, and an outer heating element assembly is shown by outer heating element segments 32*a*, 32*b* and 32*c*. These heating element assemblies may be collectively referred to herein as inner heating element assembly 30 and outer heating element assembly 32, respectively. Each individual heating element segment pair (for example, pair 30*a* and 32*a*) is separated from adjacent heating element segment pairs by three cooking surface supports 34 that extend radially from a center of a cooking surface. While FIG. 3 depicts the cooking surface as having three cooking supports 34, it will be appreciated that a cooking apparatus according to the present disclosure may have either more or fewer supports, depending upon the material properties and desired rigidity of cooking surface 24.

Inner heating element segments 30*a-c* are connected in series to form inner heating element assembly 30, and outer heating element segments 32*a-c* may likewise be connected in series to form outer heating element assembly 32. For example, each inner heating element segment (for example, 30*b*) includes a first terminal 35 and a second terminal 36. First terminal 35 of one inner heating element segment may be electrically to second terminal 36 of an adjacent inner heating element segment to electrically connect the two segments. Likewise, outer inner heating element segment (for example, 32*c*) includes a first terminal 37 and a second terminal 38 connectable in a like fashion. In this manner, inner heating element segments 30*a-c* can be connected together in series such that the inner heating element segments 30*a-c* act as a single heating element, and likewise for outer heating elements 32*a-c*. This arrangement may allow inner heating element assembly 30 to be controlled independently of outer heating element assembly 32, and therefore may allow generally concentric temperature zones on cooking surface 24 to be maintained at controllably different temperatures. Two terminals of inner heating element assembly 30 and two terminals of outer heating element assembly 32 may be connected to one or more power supplies to provide power for the heating element assemblies 30 and 32.

While the depicted heating elements are disclosed as heating generally concentric inner and outer heating zones, it will be appreciated that the heating elements may be configured to create separate heating zones of any other suitable shape, and/or any other suitable number of heating zones besides the depicted two. Furthermore, it will be understood that many of the concepts disclosed herein may be also be applicable to cooking systems with a single heating element.

Any suitable type of electric heating elements may be used as heating element assemblies 30 and 32. For example, the electric heating elements may be tubular or strip heating elements. In one exemplary embodiment, the heating elements are etched foil mica heating elements. Likewise, the heating elements may have any suitable power rating and thermal output. In one exemplary embodiment, the inner heating element(s) may have a maximum power of 1700 Watts, and the outer element(s) may have a maximum power of 6900 Watts. In another exemplary embodiment, the inner heating element(s) may have a maximum power of 3500 Watts, and the outer element(s) may have a maximum power of 4500 Watts. It will be appreciated that these values are merely set forth for the purpose of example, and that the inner and outer heating elements may have any other suitable maximum power outputs. These exemplary configurations of heating elements may be used to generate highly controllable cooking surface temperatures in the range of 150-800 degrees Fahrenheit. It will be appreciated that other wattages may be applied or used to vary the cooking surface temperature. The typical voltages used to power the heating elements include voltages of 240-208/120 VAC/60 HZ, using 3-wire conduit. International voltage conversions may also be applied.

Figure 4:
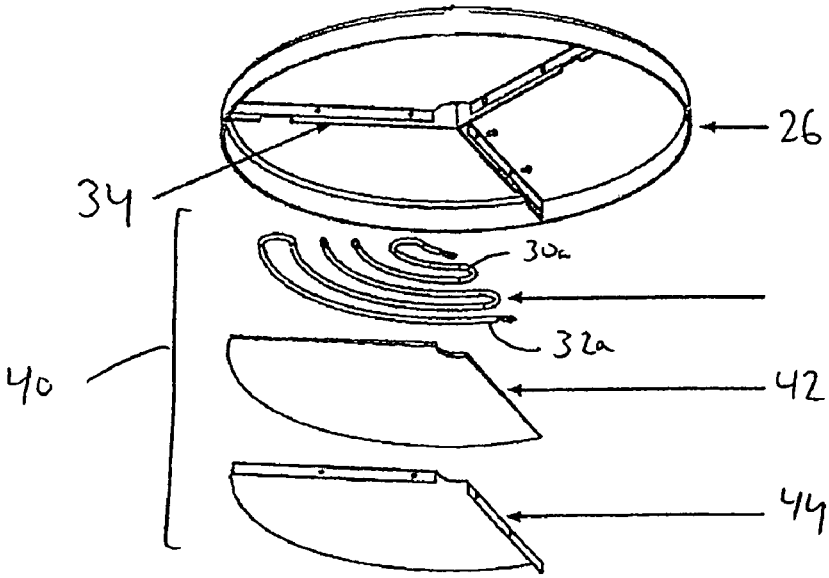
FIG. 4 shows an exploded view of an underside of a cooking surface and a portion of a heating element assembly of the embodiment of FIG. 1.

Heating elements 30*a-c* and 32*a-c* may be contained in modular or otherwise separated assemblies coupled to or attached to the underside of the cooking surface. FIG. 4 shows an exploded view of an exemplary module 40. Module 40 may include an inner heating element segment 30*a*, an outer heating element segment 32*a*, a ceramic fiber blanket 42 for insulation, and a containment shield 44 holding the module to the cooking surface and containing the module components. Each module 40 may be electrically bridged by connecting wires (not shown) to adjacent modules, thereby completing the circuits for inner heating element assembly 30 and outer heating element assembly 32. In alternate embodiments, heating element assemblies 30 and 32 may be spaced from the underside of cooking surface 24, and/or may be insulated in any other suitable manner.

Base 29, as well as any other suitable portion of cooking apparatus 10, may be designed with a dual wall construction for zero clearance installation to any suitable structure, including but not limited to indoor kitchen counters, outdoor masonry kitchens, metal cabinet enclosures, etc., and other combustible and non-combustible surfaces. Likewise, rubber feet (not shown) may be mounted to an underside of the cooking apparatus to allow the cooking apparatus to be placed on a banquet table or other support surface in a portable configuration.

Figure 5:
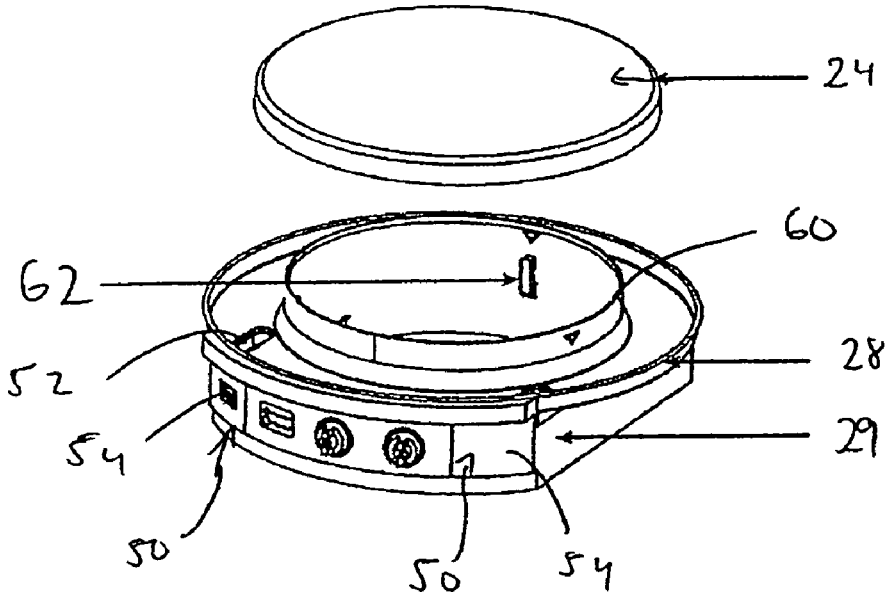
FIG. 5 shows a partially exploded front perspective view of the embodiment of FIG. 1.
Figure 6:
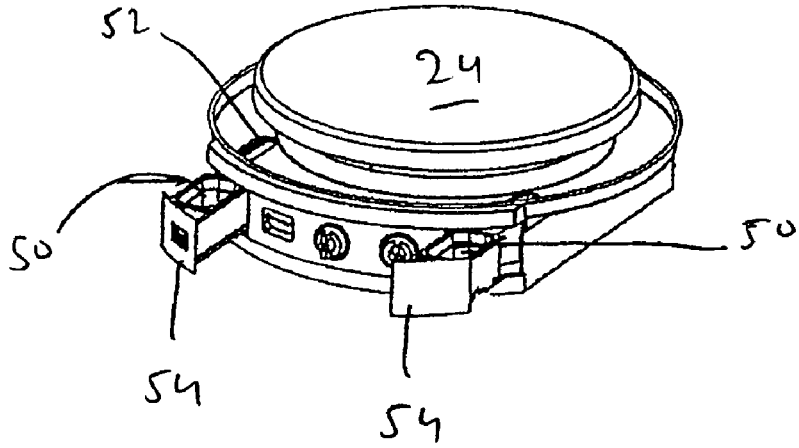
FIG. 6 shows a front perspective view of the embodiment of FIG. 1, with a plurality of spillover tray drawers shown in an opened position.
Figure 7:
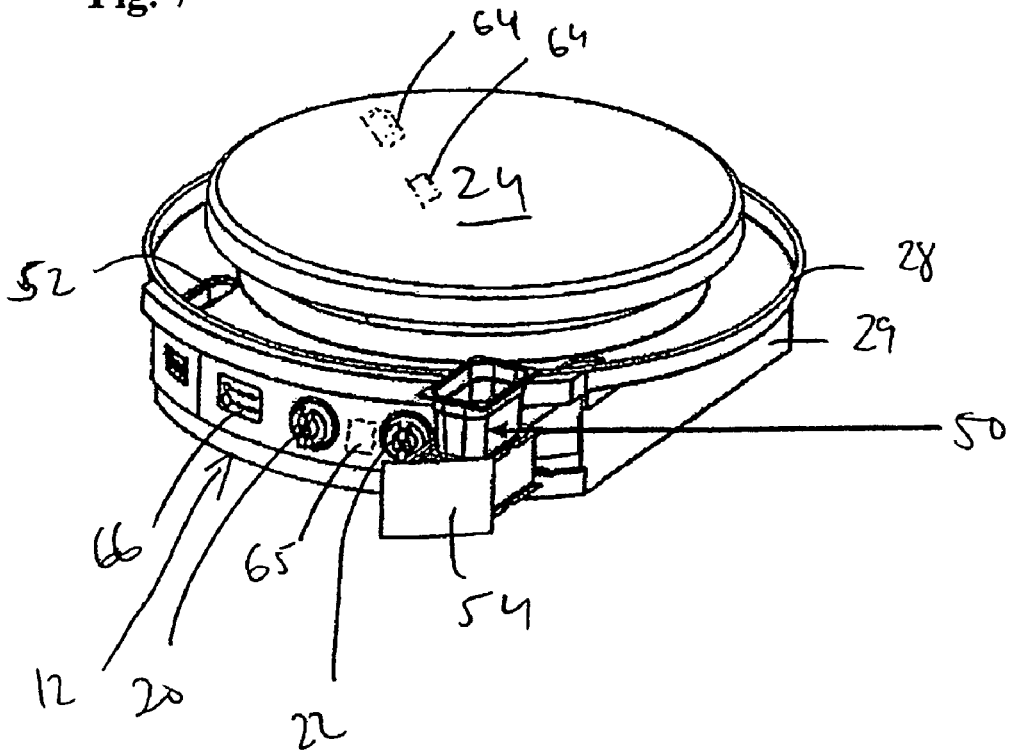
FIG. 7 shows a front perspective view of the embodiment of FIG. 1, with a spillover tray drawer shown in an open position and a spillover tray shown elevated from the spillover tray drawer.

Referring next to FIGS. 5-7, drip pan spillover trays 50 may be located beneath drip pan 28. Drip pan 28 may likewise include holes 52 through which drippings may flow for collection in spillover trays 50. In the depicted embodiment, drip pan spillover trays 50 are located behind control panel 12, and are supported in drawer-like structures 54. Drip pan spillover trays 50 may be accessed for cleaning by pulling the drawers 54 out, and then removing trays 50 from drawers 54. It will be appreciated that the depicted drip pan spillover tray arrangement is merely exemplary, and that the drip pan spillover trays may be located in any other suitable position and may be removable for cleaning via any other suitable mechanism.

An exemplary mechanism for the attachment of the drip pan is shown in more detail in FIG. 5. As shown, cooking surface 24 is disposed on an open cylinder-shaped skirt 60. Drip pan 28 is secured to this skirt with one or more adjustable draw latches 62. Latches 62 are mounted to an inside wall of the skirt, and allow precise alignment of drip pan 28 to the surfaces of the structure to which the cooking apparatus is mounted (for example, laminate, granite, marble, etc.).

Temperature detectors, depicted schematically at 64 in FIG. 7, may be mounted to or integrated with cooking surface 24 in one or more locations to sense the cooking surface temperature. In one embodiment, two detectors are mounted to the underside of the cooking surface such that one detector is provided for each heating zone). The signals from temperature detectors 64 may be provided to a controller 65 associated with control panel 12. The controller may control the display of the heating zone temperatures on a display 66 positioned on control panel 12. Display 66 may be any suitable type of display, including but not limited to, an LCD or OLED display. Any suitable type of temperature detectors may be used as temperature detectors 64, including but not limited to resistive detectors, optical detectors, etc. Likewise, any suitable number of temperature detectors may be used. For example, each cooking surface temperature zone may include one temperature sensor, or may include more than one sensor.

Furthermore, temperature sensors 64 may be configured to provide feedback to allow the controller to control the temperatures of each heating zone to keep the temperatures within a desired range. In one embodiment, the temperature sensors and controller may be configured to maintain accurate temperatures within a maximum range of approximately 150-500 degrees Fahrenheit. In alternative embodiments, the controller may be configured to maintain temperatures outside of this range.

Figure 8:
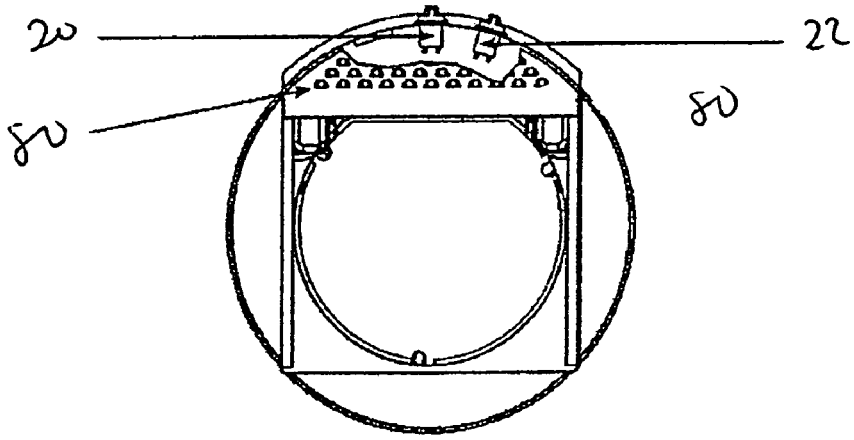
FIG. 8 shows a bottom view of the embodiment of FIG. 1.

As described above, separate temperature control knobs 20, 22 may be provided to allow the independent control the temperature of each cooking surface temperature zone. Control knobs 20, 22 may, for example, have printed on a flat peripheral edge an "off" location, followed by temperature settings "warm", "low", "medium" and "high." Likewise, control panel 12 may include a legend located above, below or to the side of the knobs identifying the inner and outer heating element control knobs. Furthermore, a master power switch (not shown) may be provided to control power to all of the electronics of the system, including each heating element 30, 32, display 66, etc. The master power switch may be located on control panel 12, or at any other suitable location. Referring to FIG. 8, the underside of control panel 12 and associated controls may be protected by a louvered venting 80 or other suitable structure. A portion of venting 80 is shown cut away in FIG. 8 to illustrate the positions of knobs 20, 22.

Figure 9A:
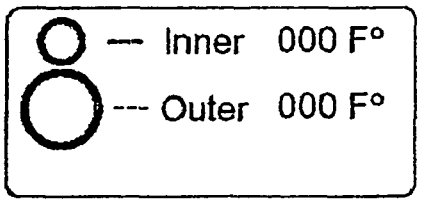
FIGS. 9A-9D show an embodiment of a display for use with the embodiment of FIG. 1, with a plurality of different temperature readings shown on the display.
Figure 9B:
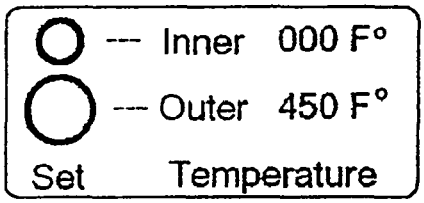
Figure 9C:
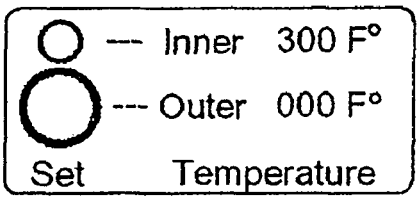
Figure 9D:
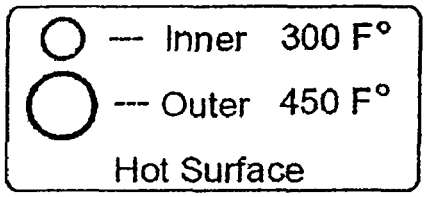

Referring to FIGS. 9*a*-9*d*, temperature control setting for either or both of control knobs 20, 22 and heating elements 30, 32 may function as follows. FIG. 9A depicts display 66 when neither burner is heated. Turning either knob from the "off" position to any temperature setting switches the corresponding heating element "on." In response, display 66 may be configured to display a "set temperature" message, as shown in FIGS. 9B and 9C. When a temperature setting process begins with a cook surface at ambient room temperature, the initial element temperature begins at a preselected level, for example, 150 degrees Fahrenheit. Any time a control knob is moved from the "off" position to any one of "warm", "low", "medium" or "high" temperature settings, the "set temperature" message is shown on display 66. After a preselected time (for example, five seconds) of knob inactivity, and if the cook surface is found with a surface temperature greater than a preselected temperature (for example, one hundred fifty degrees Fahrenheit), the display may display a "Hot Surface" message, as shown in FIG. 9D.

To heat a desired heating zone on cooking surface 24, the corresponding control knob 20, 22 is turned from the "off" position to the "warm" setting. If control knob 20 or 22 is rotated past "warm" to any location between the "warm" and "high" settings, the control panel may be configured to show the target temperature related to the selected knob position, as shown in FIGS. 9B and 9C. This display may be displayed for any desired amount of time before the display reverts to the actual cooking surface temperatures detected by the temperature detectors. In one specific embodiment, when the knob is paused at a selected temperature, the target temperature associated with the selected knob location may display the target temperature at steady state for two seconds, and then flash the temperature 2-5 times before reverting to displaying the actual cooking zone temperature.

Controller 65 may be configured to increase or decrease the heating element temperatures in steps of any suitable size. For example, the temperature variations may occur in steps of 5-50 degrees Fahrenheit. In one specific embodiment, the temperature variations occur in steps of 25 degrees Fahrenheit.

In the foregoing specification, various features are described with reference to specific embodiments thereof. It will, however, be evident that various modifications and changes can be made thereto without departing from the broader spirit and scope of the disclosure. The specification and drawings are, accordingly, to be regarded in an illustrative rather than a restrictive sense.

Furthermore, it will be appreciated that the various embodiments of heater elements, cooking surfaces, base constructions, etc. are exemplary in nature, and these specific embodiments are not to be considered in a limiting sense, because numerous variations are possible. The subject matter of the present disclosure includes all novel and non-obvious combinations and subcombinations of the various features, functions, and/or properties disclosed herein. The following claims particularly point out certain combinations and subcombinations regarded as novel and nonobvious. These claims may refer to "an" element or "a first" element or the equivalent thereof. Such claims should be understood to include incorporation of one or more such elements, neither requiring nor excluding two or more such elements. Other combinations and subcombinations of the various features, functions, elements, and/or properties disclosed herein may be claimed through amendment of the present claims or through presentation of new claims in this or a related application. Such claims, whether broader, narrower, equal, or different in scope to the original claims, also are regarded as included within the subject matter of the present disclosure.

What is claimed is:

1. An electrical cooking apparatus, comprising:

a base supporting a substantially continuous cooking surface;

a plurality of electrical heating elements disposed under the substantially continuous cooking surface;

at least two temperature controllers configured to allow independent control of temperatures of at least two of the plurality of heating elements;

a drip pan adjustably coupled to the base and positioned below the cooking surface such that the drip pan is alienable to a surface of a structure to which the cooking apparatus is to be mounted, the drip pan comprising a hole;

a drawer disposed below the hole in the drip pan, the drawer being positioned to receive drippings from the hole in the drip pan when closed and to allow access for cleaning when opened; and a spillover tray positioned in the drawer.

2. The electrical cooking apparatus of claim 1, wherein the drip pan is adjustably coupled to the base via one or more adjustable draw latches.

3. The electrical cooking apparatus of claim 1, wherein at least one inner heating element is formed from a plurality of inner heating element segments and at least one outer heating element is formed from a plurality of outer heating element segments.

4. The electrical cooking apparatus of claim 3, wherein each inner heating element segment is separated from an adjacent inner heating element segment by a separator disposed on an underside of the cooking surface.

5. The electrical cooking apparatus of claim 3, wherein the outer heating element substantially surrounds the inner heating element.

6. The electrical cooking apparatus of claim 1, wherein the cooking surface is crowned.

7. The electrical cooking apparatus of claim 1, wherein the cooking surface is substantially flat.

8. The electrical cooking apparatus of claim 1, wherein the cooking surface has a substantially circular perimeter.

9. The electrical cooking apparatus of claim 1, wherein the drip pan comprises a plurality of holes, and wherein the electrical cooking apparatus further comprises a drawer positioned beneath each hole in the drip pan.

10. The electrical cooking apparatus of claim 1, wherein the cooking surface rests on a skirt that surrounds the plurality of heating elements.

11. An electrical cooking apparatus, comprising:

a base supporting a substantially continuous cooking surface;

a drip pan adjustably coupled to the base and positioned below the cooking surface, the drip pan comprising a hole;

a drawer disposed below the hole in the drip pan, the drawer being positioned to receive drippings from the hole in the drip pan when closed and to allow access for cleaning when opened;

a spillover tray positioned in the drawer;

an inner electrical heating element assembly positioned beneath a centrally disposed region of the cooking surface, the inner heating element assembly comprising at least two inner heating element segments;

an outer electrical heating element assembly disposed beneath a radially outer region of the cooking surface, the outer heating element assembly comprising at least two outer heating element segments;

an inner element temperature control configured to allow control of the inner electrical heating element assembly; and an outer element temperature control configured to allow control of the outer electrical heating element assembly.

12. The electrical cooking apparatus of claim 11, wherein the drip pan is coupled to the base via one or more adjustable draw latches.

13. The electrical cooking apparatus of claim 11, wherein the inner heating element segments are connected in series, and wherein the outer heating element segments are connected in series.

14. The electrical cooking apparatus of claim 11, wherein the inner heating element assembly comprises three inner heating element segments, and wherein the outer heating element assembly comprises three outer heating element segments.

15. The electrical cooking apparatus of claim 1, wherein one or more of the heating elements comprises a mica heating element.

16. The electric cooking apparatus of claim 11, wherein one or more of the heating element segments comprises a mica heating element.

17. An electrical cooking apparatus, comprising:

a base supporting a substantially continuous cooking surface;

a plurality of electrical heating elements disposed under the substantially continuous cooking surface;

a temperature controller; and a drip pan adjustably coupled to the base at a location below the cooking surface such that the drip pan is alignable to a surface of a structure to which the cooking apparatus is to be mounted.

18. The electrical cooking apparatus of claim 17, wherein the drip pan is adjustably coupled to the base via one or more adjustable draw latches.

19. The electrical cooking apparatus of claim 18, wherein the base comprises a skirt supporting the cooking surface, and wherein the one or more adjustable draw latches are mounted to an inside wall of the skirt.

* * * * *